US011540361B2

(12) United States Patent
Corrado et al.

(10) Patent No.: US 11,540,361 B2
(45) **Date of Patent: *Dec. 27, 2022**

(54) WIRELESS AMAGNETIC HEATING MODULE

(71) Applicant: E-WENCO S.R.L., Legnano (IT)

(72) Inventors: Ennio Corrado, Legnano (IT); Chiara Cremonesi, Legnano (IT)

( * ) Notice: Subject to any disclaimer, the term of this patent is extended or adjusted under 35 U.S.C. 154(b) by 424 days.

This patent is subject to a terminal disclaimer.

(21) Appl. No.: 16/605,676

(22) PCT Filed: Apr. 19, 2018

(86) PCT No.: PCT/IT2018/050067

§ 371 (c)(1),
(2) Date: Oct. 16, 2019

(87) PCT Pub. No.: WO2018/198148

PCT Pub. Date: Nov. 1, 2018

(65) Prior Publication Data

US 2020/0137840 A1 Apr. 30, 2020

(30) Foreign Application Priority Data

Apr. 27, 2017 (IT) ..... 102017000045932

(51) Int. Cl.
*H05B 6/10* (2006.01)
*H05B 6/34* (2006.01)

(52) U.S. Cl.
CPC ..... *H05B 6/108* (2013.01); *H05B 6/34* (2013.01)

(58) Field of Classification Search
CPC ..... H05B 6/108; H05B 6/105; H05B 6/34
See application file for complete search history.

(56) References Cited

U.S. PATENT DOCUMENTS 5,064,055 A * 11/1991 Bessenbach ..... A47J 36/02 220/573.1
5,378,879 A * 1/1995 Monovoukas ..... H05B 6/106 156/379.7
2011/0301363 A1* 12/2011 Friese ..... B01J 14/00 568/309

FOREIGN PATENT DOCUMENTS

DE 10 2008 056991 A1 5/2010
DE 10 2014 105808 A1 10/2015

OTHER PUBLICATIONS

ISR; European Patent Office; NL; Jul. 12, 2018.

* cited by examiner

*Primary Examiner* — Dana Ross
*Assistant Examiner* — Joe E Mills, Jr.
(74) *Attorney, Agent, or Firm* — Quickpatents, LLC; Kevin Prince

(57) ABSTRACT

A non-magnetic wireless heating module is described. The module consists of a, preferably embossed, surface or plane and a dielectric surface or plane. The surface or plane is made of an inductive non-magnetic metal alloy that contains a first amagnetic metal or a first non-magnetic mixture of metals in a percentage between 85% and 99.99% by weight to the total weight and contains a second ferromagnetic or ferrimagnetic metal or a second ferromagnetic or ferrimagnetic mixture of metals in a percentage between 0.01% and 15% by weight to the total weight. The wireless amagnetic heating module is inserted into a chamber (for example a pipe or a portion of a pipe, a cubic container, a cistern . . . ) for the passage or storage of fluids, liquids, gases or solids; when the wireless amagnetic heating module is subjected to a variable electromagnetic field, it heats up, allowing heating, drying, passage of phase, . . . of the material in contact with it and contained in the chamber.

15 Claims, 3 Drawing Sheets

[Fig. 1]
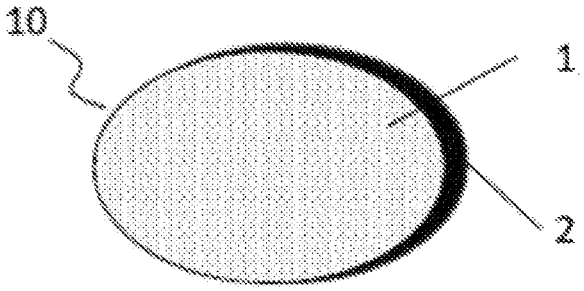
[Fig. 2]
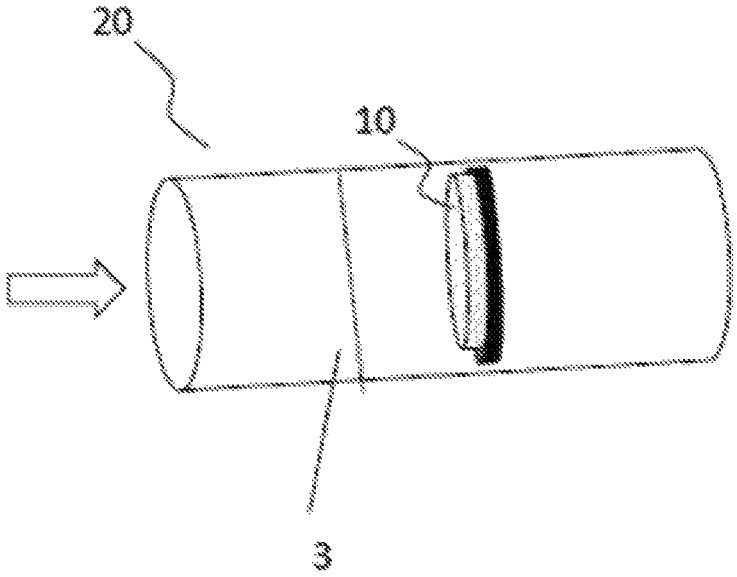
[Fig. 3]
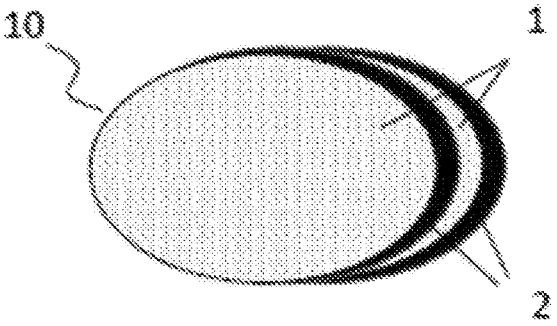

[Fig. 4]
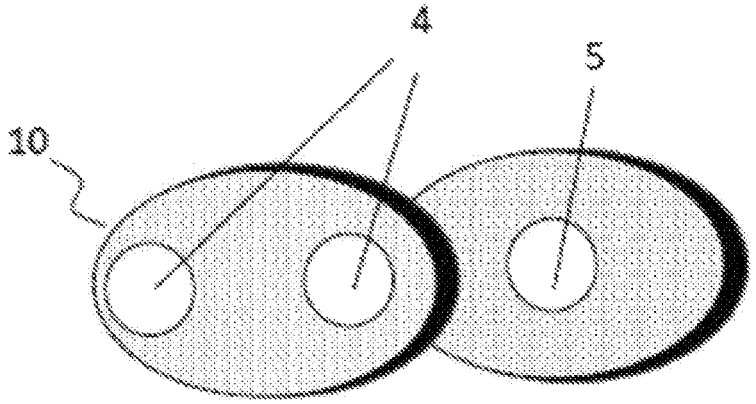
[Fig. 5]
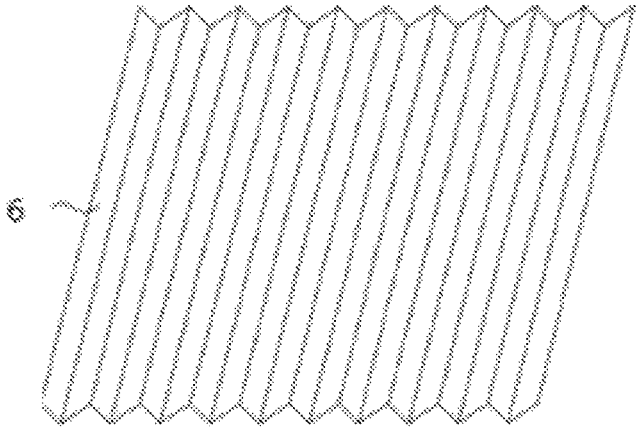
[Fig. 6]
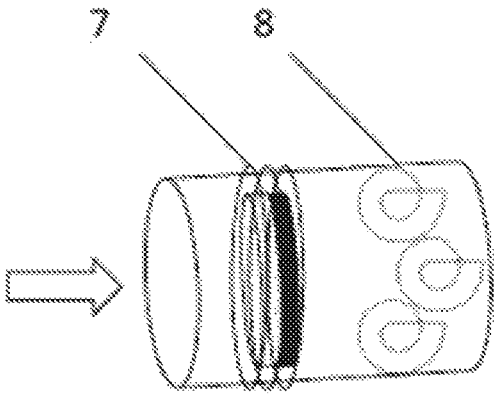

[Fig. 7]
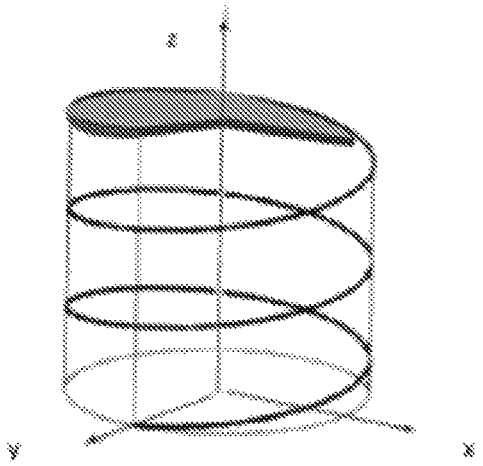
[Fig. 8]
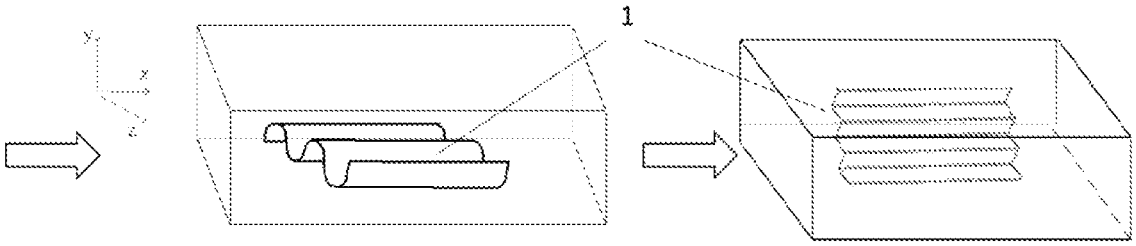
Fig 8A Fig 8B
[Fig. 9]
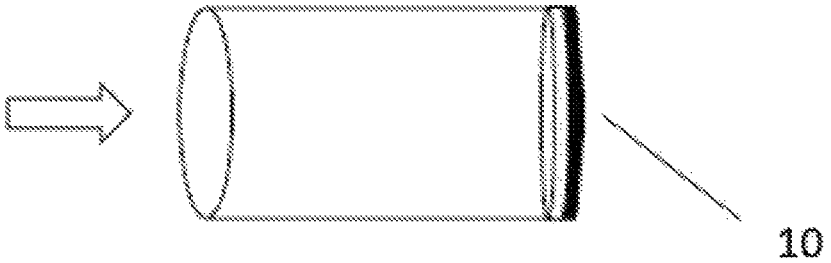

WIRELESS AMAGNETIC HEATING MODULE

TECHNICAL FIELD

The present invention relates to a wireless induction heating module in amagnetic metal alloy.

Induction heating modules of this type can be used to heat fluids or solids or gases in motion or stored in closed environments, where the wireless amagnetic heating module, object of the present invention, is placed or integrated within the storage or passage chamber for heating fluids, gases or solids in industrial processes.

BACKGROUND ART

Many industrial and domestic processes involve heating a fluid, a solid or a gas contained within a chamber of different sizes and shapes (for example a tube or a portion of a pipe, a cubic container, a cistern . . . ). Consider, for example, industrial drying processes or water heating in the civil sector.

Conventionally, the material to be heated can be heated through external heating sources which insist on the walls of the chamber (for example a cistern, a pipe, . . . ) which, in turn, condense and irradiate the material inside it; or it is possible to heat a material in a chamber through the passage of a hot fluid, more commonly hot air, which in addition to releasing heat to the material, can act as a carrier to remove excess water as occurs for example for drying bed fluid processes.

The most known external heat sources are free flame, infrared and electrical resistors.

In heating with open flame, the heat is generated by the combustion of gaseous or liquid fuels such as gas, oil, wood, pellets, rapeseed oil, . . . . The free flame is excellent for those processes that require very high temperatures, but it is one of the most inefficient and difficult to control systems. Furthermore, since the combustion phenomenon is an exothermic redox reaction, the reaction residues depend on the fuel used, among which are common biomass and wood, strongly polluting the release of fine dust in the atmosphere, and the methane gas responsible of the release of carbon dioxide into the air, one of the largest greenhouse gases. The use of fuels, moreover, requires a periodical control of the state of the ducts to prevent dangerous leaks, with consequent additional maintenance costs.

Infrared radiation is part of the electromagnetic spectrum: those with a wavelength of between 700 nm and 1 mm, with a frequency lower than that of visible light but higher than that of radio waves. Infrared heaters are generally quite compact and allow accurate temperature control, and the heat can be applied evenly and extensively. However, due to the nature of the process itself, the emission behaviour of the infrared radiator must be optimally adapted to the absorption behaviour of the product to be treated, so it is not possible to establish a standard parameter with maximum efficiency common to multiple uses and applications.

The electric heaters are characterized by a concentration of heat on small surfaces. At the basis of heat generation, there is a resistive process with a continuous passage of electric current that insists on the metal structure of the resistances causing wear and malfunction over time with reduction of overall efficiency. Moreover, as for the free flame, this type of heating manifests significant energy dispersions on the outside by irradiation and conduction and energy consumption higher than the real energy requirement of the process.

It is also known that a larger contact surface allows a greater and more efficient heat exchange with the material to be heated or dried. This important principle takes advantage of some solutions such as the equicurrent and countercurrent rotary dryers and the fluid bed dryer which previously provides the heating of drying fluids (e.g. air). Said fluids are excellent vectors for removing excess water vapor in the drying chamber, but they are however a very poor heat exchanger because they have reduced contact surfaces due to the low density of the gaseous phase.

An optimal solution could be a heating source with a large contact surface and a variable thermal power density that can be placed inside the chamber where the material to be heated is housed.

An optimal solution could be to place an electromagnetic induction heating module inside the container or the drying chamber.

One of the advantages of electromagnetic induction is the ability to work remote heating sources with respect to the emitter of the electromagnetic wave and thus work safely, wirelessly.

In fact, it is known that by subjecting a metallic element to a magnetic field variable in space and/or time, electric currents are induced in the element itself; these electric currents are defined parasitic currents (or Eddy currents) and, in their turn, they heat the metal element by Joule effect.

A wireless heating module for heating fluids or solids or gases moving or stored in closed environments, inserted into the chamber containing the material to be heated, would bring considerable advantages including an important electrothermal safety and a reduced heat dispersion thanks to the concentration of the heat inside the chamber and the complete immersion of the material in the fluid, solid, gas . . . .

However, not all metals are suitable for heating processes that exploit this phenomenon; in fact, it is necessary to use a metal that has electrical resistance sufficiently low to efficiently conduct the eddy current induced, but beyond a certain lower limit of the electrical resistance the sufficient energy dissipation is not obtained to heat the object by Joule effect. Therefore, over time, ferromagnetic or high ferrimagnetic metals have been preferred, responding to electromagnetic fields, so much that de facto standards have been created in the reference markets.

The most commonly used ferromagnetic materials are iron, cobalt and nickel and their alloys.

However, ferromagnetic materials have strong limits in their use for heating processes for fluids, solids and gases, stationary or in transition, since they have low thermal conductivity which needs to be compensated with important inertial masses; moreover they can not come into direct contact with edible material or material that could absorb iron, cobalt and nickel particles or thermolabile material that requires a careful temperature control.

The inductive process with ferromagnetic metals is physiologically subject to the risk of suffering from important and uncontrolled thermal drifts that could compromise the material contained in the chamber.

All these limits make the use of non-ferromagnetic metals desirable, characterized by maximum thermal conductivity, lightness and ductility.

SUMMARY OF INVENTION

The object of the present invention is to provide an amagnetic wireless heating module for heating fluids or solids or gases moving or stored in closed environments, where the wireless amagnetic heating module is placed or integrated inside the storage chamber or of passage of materials.

Another object of the present invention is to provide a fluid, solid or gas heating device composed of one or more wireless heating modules in an amagnetic alloy.

Another object of the present invention is to provide an amagnetic wireless heating module with an embossed surface which allows greater heat diffusion thanks to the greater contact surface with the material to be heated, conferred by the embossing.

Another object of the present invention is to provide a fluid, solid or gas heating device composed of "n" wireless amagnetic heating modules of homogeneous or inhomogeneous shape and size.

Another object of the present invention is to provide a fluid, solid or gas heating device composed of "n" contiguous wireless spiral-shaped amagnetic heating modules developed in the xyz dimensions.

Another object of the present invention is to provide a fluid, solid or gas heating device composed of "n" wireless amagnetic heating modules spaced by a dielectric element having homogeneous or inhomogeneous dimensions and shapes.

Another object of the present invention is to provide an amagnetic wireless heating module which allows to rapidly heat liquids, solids and gases in motion; said movement, preferably along one or more axes, can be generated by the movement of the chamber around the wireless amagnetic module or it can be generated by the movement of the module itself.

Another object of the present invention is to provide an amagnetic wireless heating module that allows to rapidly heat liquids, solids and gases.

Another object of the present invention is to provide an amagnetic wireless spiral heating module, developed on the xyz axes, and which allows heating and at the same time facilitating transit into a cylindrical container (for example a tube) of the material.

These and other objects are achieved by means of a wireless amagnetic heating module consisting of a preferably embossed plane or surface, made of an inductive amagnetic alloy, to which a dielectric surface or a transparent plane to the electromagnetic fields is associated.

The embossing of the surface or of the amagnetic inductive alloy surface bestows a larger contact surface with the fluid to be heated, thus improving the heat exchange.

The preferably embossed plane or surface consists of at least one layer of a amagnetic inductive metal alloy composed of a first amagnetic metal or a first amagnetic metal mixture in percentages ranging from 85% to 99.9% by mass over the total alloy (% wt), and containing a second ferromagnetic or ferrimagnetic metal or a second mixture of ferromagnetic or ferrimagnetic metals in a percentage ranging from 0.1% to 15% by mass over the total alloy (% wt), which is immersed in an induced electromagnetic field, heats the material (fluid, solid and/or gas) with which it comes into contact.

The dielectric surface, or plane, has the purpose of supporting the preferably embossed surface or plane in amagnetic inductive alloy, avoiding any inclinations and bends due to a reduced thickness of the preferably embossed surface or plane and the possible passage of a moving material inside the room; furthermore, the dielectric surface or plane is made of poorly or entirely non-inductive material such as plastic, glass, ceramic, . . . and allows an easier anchoring to the walls of the chamber.

The dielectric surface, or plane, may also have a shape and dimensions similar or dissimilar to the surface or top made of a amagnetic inductive alloy.

A so-called wireless amagnetic heating module would provide significant advantages including an important electrothermal safety since there are no direct electrical current passes in the module.

Moreover, the use of inductive amagnetic alloys, unlike traditional inductive ferromagnetic alloys, allows to choose among metals those with higher thermal conductivity (as reported in the tables below) so that the heat generated is easily transferred to the material in contact thanks to the complete immersion of the module in the fluid, solid, gas . . . to be treated.

Silver, copper, gold and aluminium will therefore be preferred.

Amagnetic Metal Table

| Material | Thermal conductivity (in $Wxm^{-1}xC^{-1}$) |
|---|---|
| Silver | 420 |
| Copper | 392 |
| Gold | 295 |
| Aluminium | 225 |

Ferromagnetic Metal Table

| Material | Thermal conductivity (in $Wxm^{-1}xC^{-1}$) |
|---|---|
| Iron | 60 |
| Nickel | 58-65 |
| Cobalt | 100 |

With these combinations of characteristics, it is possible to obtain a very effective and efficient wireless module in the heating, drying, of stationary materials or in transit inside enclosed spaces/chambers.

The objects of the present invention are also achieved by the methods described and claimed, which allow to obtain induction wireless amagnetic heating modules that allow to directly heat the material contained in a storage chamber or for the transit of material, with obvious production advantages, costs and maintenance.

For the purposes of the present invention the term "plane" or "surface" is used to identify a surface with dimensions x, y and z where z is significantly less than x and y.

For the purposes of the present invention the term "alloy" is used to identify materials in which the mixing of metals or other constituents is intentional. Therefore, the term "alloy" disregards the presence or absence of unwanted impurities that may derive from the nature of the minerals from which the compounds are extracted and/or from the extraction and metallurgical processes used.

Furthermore, in the present invention, for "amagnetic materials" we mean all those materials, such as diamagnetic or paramagnetic which do not interact appreciably with magnetic fields.

On the contrary, for "ferromagnetic or ferrimagnetic materials" we mean all those materials that interact appreciably with magnetic fields.

Commonly these materials are also called magnetic materials.

Furthermore, in the present invention by "inductive amagnetic alloy" we mean a metal alloy containing a first metal or a first mixture of metals in a percentage ranging from 85% to 99.9% by weight on the total and containing a second metal or a second metal mixture in a percentage ranging from 0.1% to 15% by weight of the total, and wherein the first metal is a amagnetic metal, for example diamagnetic or paramagnetic or antiferromagnetic, or the first metal mixture is amagnetic and/or it may comprise only amagnetic metals, and the second metal is a ferromagnetic or ferrimagnetic metal, or the second metal mix comprises exclusively ferromagnetic or ferrimagnetic metals. Moreover, the inductive amagnetic alloy can contain less than 1% by weight of one or more rare earth elements, where rare earths are identified according to the IUPAC definition, or an oxide thereof, or MischMetal, in turn composed of 50% of cerium, 25% lanthanum and a small percentage of neodymium and praseodymium or non-metals, such as carbon, and/or semimetals, such as silicon.

Furthermore, in the present invention, the term camera means a closed or open or partially open container on one or more sides, of any shape or size that houses the material, in transit or stationary, to be heated through the wireless amagnetic heating module.

BRIEF DESCRIPTION OF DRAWINGS

Further characteristics and advantages of the invention will be better highlighted by examining the following detailed description of a preferred but not exclusive embodiment, illustrated by way of non-limiting example, with the support of the accompanying drawings, in which:

FIG. 1 shows schematically a sectional view of a wireless amagnetic heating module 10 made up of a surface or plane embossed in amagnetic metal alloy 1, to which a dielectric surface or plane 2 is associated.

FIG. 2 schematically shows a sectional view of a generic tube-shaped chamber 20, which contains the material to be heated or dried, with diameter/section 3 and inside which the amagnetic wireless heating module 10 2 is inserted.

FIG. 3 schematically shows a sectional view of a wireless amagnetic heating module composed of several wireless heating modules 10.

FIG. 4 schematically shows a sectional view of a wireless amagnetic heating module composed of several wireless amagnetic heating modules 10 having slots 4 and 5 respectively positioned at the sides and in the middle of the wireless amagnetic heating modules.

FIG. 5 schematically shows an example of embossing 6 of the embossed surface or plane 1.

FIG. 6 schematically shows a sectional view of a chamber where the inductor element is positioned externally composed of a solenoid 7 which insists on the entire surface of the chamber or by one or more flat spirals 8 which partially or completely cover the surface of the chamber.

FIG. 7 schematically shows a sectional view of a amagnetic wireless spiral heating module, developed on the 3 xyz axes.

FIG. 8 schematically shows a sectional view of a wireless amagnetic heating module in a parallelepiped-shaped chamber, arranged parallel to the inlet flow (FIGS. 8*a* and 8*b*).

FIG. 9 shows schematically a sectional view of a wireless amagnetic heating module 10 placed in one of the walls of the chamber, in this case on the bottom of the same.

DESCRIPTION OF EMBODIMENTS

The present invention relates to a wireless amagnetic heating module 10 of size xyz where, xy are the dimensions of the plane and z is the thickness, composed of a preferably embossed surface or plane 1, to which a dielectric surface or plane 2 is associated. transparent to electromagnetic fields.

The wireless amagnetic heating module 10 preferably assumes a cylindrical shape with a diameter of 1 cm to 1 meter or more generally a surface xy of less than 5 m2. The thickness z is typically comprised between 6 micrometers and 10 cm, preferably from 10 micrometers to 500 micrometers. In case of application of the inductive amagnetic metal alloy on dielectric supports using techniques such as vacuum sputtering in plasma the thickness z is between 0.5 and 6 micrometers.

The preferably embossed surface or plane 1 consists of at least one layer of a amagnetic inductive metal alloy composed of a first amagnetic metal or a first amagnetic metal mixture in percentages ranging from 85% to 99.9% by mass over the total alloy (% wt), and containing a second ferromagnetic or ferrimagnetic metal or a second mixture of ferromagnetic or ferrimagnetic metals in a percentage in the range 0.1%-15% by mass of the total alloy (% wt), which is immersed in an induced electromagnetic field, heats the material (fluid, solid and/or gas) with which it comes into contact.

The preferably embossed surface or plane 1 can have different embossing shapes; dotted as in FIG. 1 or accordion as in FIG. 5 or undulating like FIG. 8*a*.

In some embodiments, the amagnetic alloy is directly applied by sputtering or analogous techniques directly on dielectric elements with thicknesses starting from 0.5 micrometers. Thanks to this form of implementation, the mechanical and physical characteristics of the wireless inductive module are improved.

The preferably embossed surface or plane 1 can be composed of a sandwich of several sheets, each of a thickness of 0.5 to 500 micrometers, of the same inductive metal alloy or of different inductive metal alloys.

In some embodiments, a dielectric element is interposed to the individual plates of the aforesaid sandwich. Preferably, the aforementioned sandwich is made under vacuum conditions.

Thanks to these embodiment, the inductive characteristics of the lamina are improved and the response time to the electromagnetic fields of the inductive amagnetic alloys is improved.

In some embodiment, the preferably embossed surface or plane 1 is joined to the dielectric plane 2, by glues or resins.

Preferably the plane, or surface, dielectric 2 is made of plastic material, polymers, resin, glass, ceramic, wood, conglomerate of oxides in powder, stone and/or materials compatible with foodstuffs.

Moreover, the plane or surface, dielectric 2 has dimensions and shapes that are the same or dissimilar to the surface made of the inductive amagnetic alloy.

The wireless amagnetic heating module 10 is crossed by an electromagnetic field generated by a solenoid 7 of FIG. 6 which can completely or partially wrap the chamber where the module is inserted or by one or more flat spirals which partially or completely cover the chamber 20.

The wireless heating module preferably has a flat shape. Advantageously, if the process requires it, the module can assume a concave or spiral shape developed on the 3 axes (FIG. 7) or undulatory (FIG. 8A) or accordion (FIG. 8B) to favor the passage of the contained material into the chamber.

The wireless amagnetic heating module 10 preferably assumes a circular shape and is inserted inside a chamber 20 (FIG. 2). The chamber can take different shapes: it can be a cylinder, or a cube, or a parallelepiped . . . it can be opened or closed by one end or closed by both ends. Depending on the shape of the chamber, the material inside it can stand or transit at different pressures, speeds and flow rates.

In some embodiments, the wireless amagnetic heating module 10 has dimensions xy smaller than the chamber section and is franked to the chamber walls; the anchoring is advantageously carried out by glues, resins, . . . which insist on the dielectric element 2.

In some embodiments, the dielectric element 2 can be an integral part of the chamber to constitute a network which holds the preferably embossed surface 1 or plane in an orthogonal position.

In some embodiments, the wireless amagnetic heating module 10 of thickness z, preferably less than 100 micrometers, is supported in an orthogonal or inclined position with an angle between 45 and 90 degrees with respect to the longitudinal axis of the chamber (FIG. 2).

In some embodiments, the wireless amagnetic heating module 10 is perforated in one or more points, as for example laterally (4) or centrally (5) thanks to this feature the module facilitates the passage of the material contained in the chamber.

In some embodiments, the hollow wireless electromagnetic heating module 10 is presented as a network, thus consisting of several holes or apertures of homogeneous or inhomogeneous size.

Thanks to these embodiment, the contact or passage of the fluid, solid or gas on the wireless heating module, is preferred.

In some embodiments, the surface or plane 1 has a lying plane oriented with angles smaller or equal to 2 steradians in each direction with respect to the plane of arrangement of the inductors.

In some embodiments, the wireless amagnetic heating module 10 is replicated "n" times, partially or all along the chamber. The various replicated wireless amagnetic heating modules may have homogeneous or inhomogeneous shape and dimensions and may be contiguous or distanced from a dielectric of homogeneous or inhomogeneous shape and size. The "n" heating modules can be arranged at any angle with respect to the plane of arrangement of the inductors.

Thanks to this embodiment, it is possible to generate temperature gradients along the entire chamber; moreover, the material in the chamber, preferably in motion, can be thus gradually heated or in different ways along the chamber section, without undergoing thermal shock; it is also possible to trigger different actions on the material such as pre-processing, melting, refining, etc.

In some embodiments, the chamber is a tube where a fluid flows in transit and needs to be heated.

In some embodiments, the chamber is a small cylindrical or cubic container where a fluid is temporarily stored for instantaneous heating.

In some embodiments, the wireless module may constitute a wall of the chamber such as the bottom of the container.

In some embodiments, the heat transferred by the wireless amagnetic heating module 10 to the material contained in the chamber is used to allow the passage of the phase of the contents, to trigger reactions such as for example polymerization, cross-linking, catalysis, melting . . . or for cooking or for dry.

In some embodiments, the heated fluid is an aqueous fluid and heating leads to fluid phase change and therefore steam generation.

In some embodiment, the heated solid is a material with melting temperatures lower than that of the wireless module and the heating, by irradiation or conduction, leads to the phase change of the material from solid to liquid (reaching the melting point).

In some embodiments, the amagnetic wireless module or camera or the amagnetic wireless module and camera are in motion. Thanks to this form of implementation, the fluid or the solid passing or disconnected, heats up more quickly and homogeneously.

EXAMPLES

Four surveys were conducted: 1, 2, 3 and 4.

Investigation Protocol 1

The experimental activities were conducted on three samples composed of:

a. cylindrical chamber made of polymeric material with an internal diameter of 33 mm, closed at both ends except for a central 3 mm hole for fluid entry;

b. a solenoid inductor outside the 12-turn cylindrical chamber, made with a multi-conductor copper wire insulated without a 1.5 mm outer pipe;

c. nr.6 wireless amagnetic heating modules composed by an embossed surface 1 (dot embossing) of about 6.3 micrometers of an amagnetic alloy as shown below;

d. a layer of adhesive resistant up to 300° C. and a dielectric plane 2 of 10 micrometers.

TABLE 3

| composition of the inductive amagnetic alloy, 1A experiment | |
|---|---|
| Diamagnetic metals | aluminium 98% |
| Ferromagnetic metal | iron 1.2% |
| Other Metals | 0.8% |

In number 6 wireless amagnetic heating modules are spaced from cylindrical dielectrics with a thickness of 2.5 mm and a diameter of 1 cm.

In number 6 wireless amagnetic heating modules are drilled and arranged as follows: first, third and fifth wireless amagnetic heating module, centrally drilled with a diameter of 33 mm; second, fourth and sixth wireless amagnetic heated module laterally drilled (2 holes) with 29 mm diameter.

The chamber houses inside water (material to be heated) in transit with a flow of 20 L/H. The solenoid has a sine wave generated by a Royer type ZVS oscillator with 24V PWM modulated power supply.

Results of the experimental tests 1: The mediated results of the three samples are presented.

Experiment 1A: Starting temperature: 25° C.; Temperature reached: 33.5° C.; Trial duration: 100 sec; Average power consumption: 315 W.

Investigation Protocol 2

The experimental activities were carried out on two samples composed of different embossed planes 1 to which a dielectric element 2 in glassonite and having a thickness of 4 millimeters having a shape and size equal to the embossed plane were associated with a glue layer.

Each amagnetic embossed surface 1 has a square shape and dimensions 50 mm by 50 mm and is composed of either 1 inductive amagnetic plate or 4 plates of the same inductive amagnetic alloy.

The inductor is composed of a 10 cm diameter flat spiral composed of 10 windings starting from the external perimeter using a copper enameled monofilament conductor with a conductive section of 1 mm.

The inductor has a sine wave generated by a Royer-type ZVS oscillator with 24V PWM modulated power supply.

Experiment 2A

Embossed amagnetic top 1 composed of a 50 mm sheet for 50 mm and a thickness of 100 micrometers of an alloy so composed.

TABLE 4

| inductive amagnetic alloy 2A experiment | | |
|---|---|---|
| Main Diamagnetic metals | Copper | zinc |
| | 64% | 35.25% |
| Ferromagnetic metals | Iron | Nickel |
| | 0.1% | 0.3% |
| Other metals | 0.35% | |

Results of the experimental tests 2A: Starting temperature: 26° C.; Temperature reached: 10° C.; Trial duration: 65 sec; Average power absorbed in the ascent: 65W.

Experiment 2B

Embossed amagnetic top 1 composed of an inductive amagnetic foil of 50 millimeters by 50 millimeters and of a thickness of about 6 micrometres composed of

TABLE 5

| inductive amagnetic alloy 2B experiment | | |
|---|---|---|
| Diamagnetic metals | Aluminium | 98% |
| Ferromagnetic metal | Iron | 1.2% |
| Other Metals | 0.8% | |

Results of the experimental tests 2B: Starting temperature: 34° C.; Temperature reached: 93° C.; Trial duration: 20 sec; Average power absorbed in the ascent: 60W.

Experiment 2C

Embossed amagnetic top 1 composed of four inductive amagnetic plates each of 50 millimeters by 50 millimeters and of a thickness of about 6 microns composed of

TABLE 6

| inductive amagnetic experiment 2C | | |
|---|---|---|
| Diamagnetic metal | Aluminium | 98% |
| Ferromagnetic metal | Iron | 1.2% |
| Other Metals | 0.8% | |

Results of the experimental tests 2C: Starting temperature: 34° C.; Temperature reached: 108° C.; Trial duration: 56 sec; Average power absorbed in the ascent: 80 W.

Experiment 2D

Embossed amagnetic top 1 composed of an inductive amagnetic foil of 50 millimeters by 50 millimeters and thickness of about 0.8 millimeters composed of

TABLE 7

| inductive amagnetic experiment 2D | | |
|---|---|---|
| Diamagnetic metals | Titanium | 99.97% |
| Ferromagnetic metal | Iron | 0.02% |
| Other Metals | 0.01% | |

Results of the 2D experimental tests: Starting temperature: 32.6° C.; Temperature reached: 79.7° C.; Trial duration: 30 sec; Average power absorbed in the ascent: 41.8 W.

Experiment 2E

Embossed amagnetic top 1 composed of an inductive amagnetic foil of 50 millimeters by 50 millimeters and thickness of about 0.8 millimeters composed of

TABLE 8

| inductive amagnetic experiment 2E | | |
|---|---|---|
| Diamagnetic metals | Silver | 97.9% |
| Ferromagnetic metal | Iron | 2% |
| Other Metals | 0.1% | |

Results of the experimental tests 2E: Starting temperature: 68.6° C.; Temperature reached: 171.6° C.; Trial duration: 30 sec; Average power absorbed during the climb: 33.3 W.

Investigation Protocol 3

A cylindrical chamber closed on the bottom with a diameter of 4 cm and a length of 6 cm was made; the walls are made of thermoformed plastic polymer, the inductor is a solenoid applied to the outside of the cylinder; inside and near the bottom of the chamber were inserted 3 disked wireless modules with a diameter of 3.5 cm, consisting of:

TABLE 9

| inductive amagnetic experiment 3 | | |
|---|---|---|
| Inductive amagnetic alloy discs: | Aluminium | 98.1% |
| | Iron | 1.5% |
| 6 micrometres thick discs | Other metals | 0.4% |
| Dielectric discs: 0.1 mm thick discs | Carbon Fiber | |

Results of the experimental tests 3: A power of 500 watts was applied, for a time of 60 seconds during which a longitudinal flow was generated inside the chamber of water initially at room temperature. In 60 seconds the water has changed its status becoming saturated steam (therefore reaching 100° C.) for a total mass of 35 g of water/steam.

Investigation Protocol 4

A parallelepiped chamber with a width of 12.5 cm, a length of 28 cm and a height of 3 cm has been created; the walls were made of 1 mm mica, the inductor is composed of two series plane spirals made of 12 cm diameter litz wire. Inside the chamber was housed the wireless module in a longitudinal position and a total length of 20 cm; the surface in amagnetic inductive alloy is composed of aluminum 98.1%, iron 1.5% and other materials for 0.4%.

The dielectric surface is composed of a net made of heat-resistant silicone anchored to the walls of the chamber.

The module has a sinusoidal wavy shape (for a total of 5 waves with an average height of 1.5 cm) and an embossed surface with parallel edges and orthogonal at the wave and parallel to the length of the module; average width of the individual foils is about 1 mm/each Results of the experimental tests 4: An air flow of 8.4 m/sec was applied for a through section of 30 cm2; applied power of 1100-1200 watts. The air flow having an input temperature of 20.5° C., exits after 180 seconds from the system with a temperature of about degrees 61° C., maintained at steady state.

The invention claimed is:

1. A wireless amagnetic heating module 10 inserted inside a chamber 20 and composed of:

an embossed surface or plane 1 consisting of at least one layer of an inductive amagnetic metal alloy consisting of a first amagnetic metal or a first amagnetic metal mixture in percentages ranging from 85% to 99.9% by mass over the total alloy (% wt), and containing a second ferromagnetic or ferrimagnetic metal or a second mixture of ferromagnetic or ferrimagnetic metals in a percentage ranging from 0.1% to 15% by mass over the total alloy (% wt), and from a dielectric surface 2 or plane transparent to electromagnetic fields.

2. A wireless amagnetic heating module 10 according to claim 1, wherein the surface or plane 1 has different types of embossing, including accordion or wave or dots.

3. A wireless amagnetic heating module 10 according to claim 1, of dimensions xyz where xy is a plane having dimensions smaller than 5 square meters and of circular or parallelepiped shape with a major axis from 1 centimeter to 1 meter, and the thickness comprised between 0.5 micrometers and 10 centimeters.

4. A wireless amagnetic heating module 10 according to claim 1, whose thickness of the plane 1 is between 0.1 micrometers to 4 centimeters.

5. A wireless amagnetic heating module 10 according to claim 1 wherein the dielectric surface or plane 2 has the same size and shape or dissimilarity to the surface or plane 1.

6. A wireless amagnetic heating module 10 according to claim 1 for heating or triggering reactions (such as for instance polymerization, cross-linking, catalysis or drying or favors the phase passage of the material such as melting, vaporization, sublimation) solid, fluid, liquid or gaseous material in motion or stationary status inside the chamber.

7. A wireless amagnetic heating module 10 according to claim 1 wherein the surface or plane 1 consists of a multilayer of several sheets having a thickness from 0.1 to 500 micrometers of the same alloy or of different amagnetic inductive metal alloys.

8. A wireless amagnetic heating module 10 according to claim 1 in which the wireless amagnetic heating module 10 is replicated in a contiguous or disjointed manner, orthogonal or transversal or parallel along the partial or entire surface of the chamber.

9. A wireless self-magnetic heating module 10 according to claim 1, hit by a variable electromagnetic field generated by a solenoid covering the chamber or by one or more flat turns placed on the outer surface of the chamber.

10. A wireless amagnetic heating module 10 according to claim 1, inserted inside or on the bottom of a cylindrical or cubic or parallelepiped chamber, closed or partially open on one or more sides.

11. A wireless amagnetic heating module 10 according to claim 1, wherein the dielectric surface or plane 2 is made of poorly or entirely non-inductive material.

12. A wireless amagnetic heating module 10 according to claim 1, in which the module is perforated in one or more points, having homogeneous or inhomogeneous shapes, or which takes the form of a homogeneous or inhomogeneous mesh network.

13. A wireless amagnetic heating module 10 according to claim 1, in which the module has a lying plane oriented with angles smaller or equal to 2 steradians in each direction with respect to the plane of arrangement of the inductors.

14. A wireless amagnetic heating module 10 according to claim 1 in a flat or concave or spiral shape developed on the 3 axis or corrugator or accordion.

15. A wireless self-magnetic heating module 10 according to claim 1, wherein the inductive amagnetic alloy is applied by sputtering or analogous techniques directly on dielectric elements with thicknesses starting from 0.5 micrometers.

* * * * *